US005318671A

United States Patent [19]

Pruitt

[11] Patent Number: 5,318,671

[45] Date of Patent: Jun. 7, 1994

[54] METHOD OF OPERATION OF NONRECOVERY COKE OVEN BATTERY

[75] Inventor: Charles W. Pruitt, Pounding Mill, Va.

[73] Assignee: Sun Coal Company, Knoxville, Tenn.

[21] Appl. No.: 878,904

[22] Filed: May 6, 1992

Related U.S. Application Data

[63] Continuation-in-part of Ser. No. 587,742, Sep. 25, 1990, Pat. No. 5,114,542.

[51] Int. Cl.[5] ..... C10B 5/08; C10B 21/20; C10B 27/06

[52] U.S. Cl. ..... 201/1; 201/15; 201/26; 201/27; 201/41

[58] Field of Search ..... 201/1, 41, 15, 26, 27; 202/270

[56] References Cited

U.S. PATENT DOCUMENTS

| | | | |
|---|---|---|---|
| 4,111,757 | 9/1978 | Carimboli | 202/93 |
| 4,124,450 | 11/1978 | MacDonald | 201/15 |
| 4,287,024 | 9/1981 | Thompson | 202/134 |
| 4,344,820 | 8/1982 | Thompson | 201/15 |
| 5,114,542 | 5/1992 | Childress et al. | 201/15 |

*Primary Examiner*—Joye L. Woodard

*Attorney, Agent, or Firm*—Kerkam, Stowell, Kondracki & Clarke

[57] ABSTRACT

A method of controlling operation of a nonrecovery coke oven battery including a plurality of elongated coke ovens constructed in side-by-side relation with each oven having a separate system of sole flues beneath each end connected to the crown of the oven by measuring the temperature in the oven and regulating the draft to the oven in response to the measured oven temperature and by measuring the temperature in the sole flue systems beneath each oven and adjusting the draft to one of the sole flue systems only in response to differences in temperature in the two sole flue systems.

9 Claims, 5 Drawing Sheets

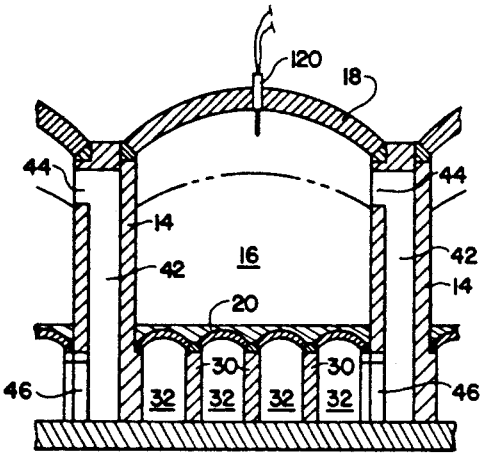
FIG. 6
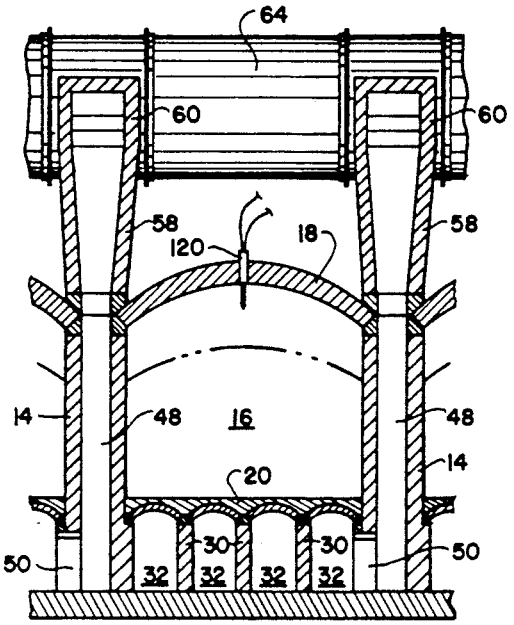
FIG. 5
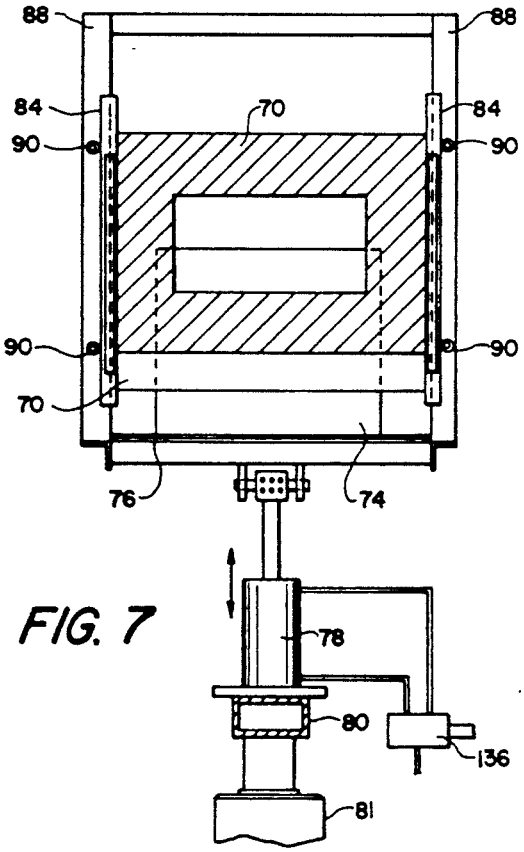
FIG. 7
FIG. 8
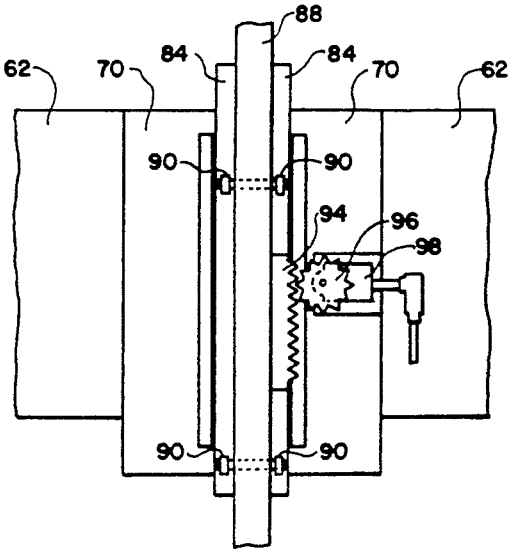

FIG. 10
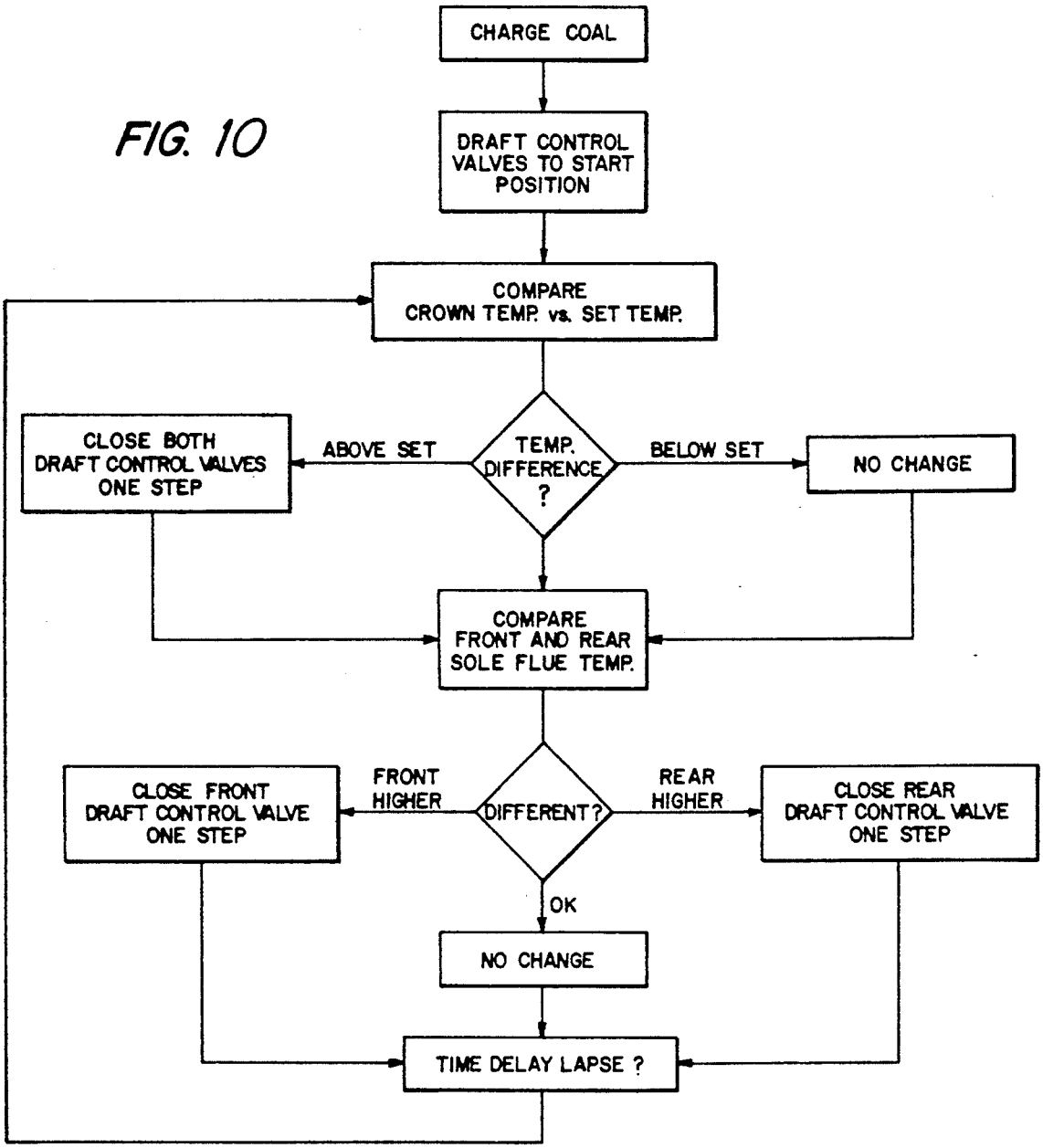
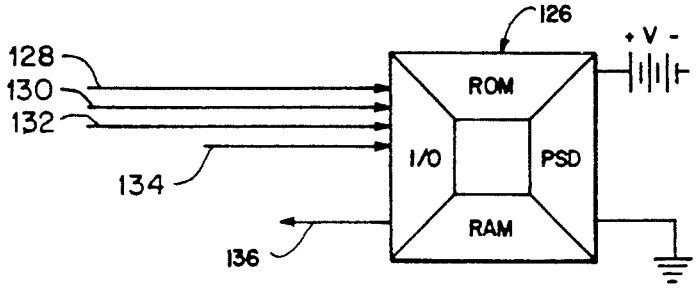
FIG. 9

METHOD OF OPERATION OF NONRECOVERY COKE OVEN BATTERY

This application is a continuation-in-part of copending application Ser. No. 587,742, filed September 25 now U.S. Pat. No. 5,114,542.

BACKGROUND OF THE INVENTION

1. Field of the Invention

This invention relates to the nonrecovery coking of coal, and more particularly to an improved method of operation of a nonrecovery coke oven battery for coking of coal.

2. Description of the Prior Art

The practice of producing metallurgical coke by a nonrecovery coking process was for many years all but abandoned in favor of the byproduct coking process in which the coke gas and other chemicals were recovered and/or refined for further use. The high cost of constructing and operating such byproduct coking plants has resulted in renewed interest in the nonrecovery process in recent years, however, and substantial improvements have been made both in the operating efficiency and the control of pollution from nonrecovery ovens. Examples of modern high speed sole flue type nonrecovery coke ovens now in operation in the United States are disclosed in Thompson U.S. Pat. Nos. 4,287,024 and 4,344,820. Such ovens are generally referred to as Thompson ovens, and the present invention is an improved method of operation of a Thompson coke oven battery.

Difficulty has been encountered in consistently obtaining a uniform coking rate throughout all the ovens in a Thompson coke oven battery constructed in accordance with the above patents. Such ovens may have a coking chamber of up to fifty (50) feet in length and up to twelve (12) feet in width, and may be filled to a depth of up to five (5) feet or more with green coal at the beginning of a forty-eight (48) hour coking cycle. Normally eight (8) or more adjacent ovens are connected through a common combustion tunnel to a single stack, and no means other than adjustable damper valves for varying the amount of combustion air admitted through inlets in the oven doors, the sole flues, and/or the common tunnel, are provided for varying the draft to the respective ovens. Each oven preferably has two systems of sole flues beneath the coking chamber and since the uptakes leading from one of the two flue systems under each of two adjacent ovens were connected through a common connector to the combustion tunnel, adjusting the combustion air to one oven necessarily effected the draft to the adjacent ovens.

In the past, combustion air to the ovens, flues and common tunnel has been regulated manually. An operator, relying on experience and a knowledge of the coking cycle, would look into the oven crowns and the sole flues, or at the exhaust at the top of the stack and, based upon the observed conditions, make adjustments to the damper valves used to control the air flow. This procedure would be repeated periodically say every one or two hours, throughout the coking cycle.

Copending application Ser. No. 587,742 now U.S. Pat. No. 5,114,542, discloses an improved Thompson coke oven battery and its method of operation in which a draft regulating valve is connected in the conduit which provides gas flow passage from each sole flue system to the common combustion tunnel. The position of the respective valves is adjusted from a central control station, relying on pressure sensors to indicate desired draft changes to regulate the draft applied by the stack through the sole flue systems to the individual ovens. That application also discloses the use of a damper valve at the top of the stack, which damper valve may be adjusted to regulate the draft applied through the common combustion tunnel to all the ovens in the battery. An operator at a remote control station, relying on signals from pressure sensors in various locations in the respective ovens, periodically adjusted the position of the respective draft regulating valves and/or the stack damper valve to maintain the draft in the individual ovens at the desired level to thereby control the coking rate in all ovens in the battery. The present invention is an improved method of operation of the coke oven battery disclosed in said U.S. Pat. No. 5,114,542, the entire disclosure of which is incorporated herein by reference.

It is a primary object of the present invention to provide an improved nonrecovery coking battery and method of its operation for the high speed coking of coal at a more uniform coking rate throughout the ovens in the battery.

Another object is to provide such a coking installation including improved means for automatically controlling and regulating the draft supplied to the individual coking ovens in a battery of ovens connected to a common stack.

Another object is to provide such a coking installation including means for automatically sensing the temperature at various locations in the individual ovens in a battery and for adjusting the draft to the respective ovens in response to the sensed temperature.

Another object is to provide such an installation and a method of its operation, which enables an increased yield of high quality coke from a charge of coal.

SUMMARY OF THE INVENTION

In the attainment of the foregoing and other objects of the invention, an important feature resides in providing a battery of Thompson coke ovens with two independent sole flue systems located under each oven. Chimney uptakes extending through the walls between adjacent ovens have their outlets connected through a duct system including draft control valves operable to regulate the flow of hot flue gases through the uptakes from each sole flue system. High temperature thermocouples sense the temperature at critical locations in the respective ovens, for example, in the crown above the oven charge and in the sole flues, and continuously provide signals to a process control computer which monitors the sensed temperature and adjusts the position of the draft regulating valves in response to the temperature in accordance with a predetermined schedule to thereby regulate the draft and consequently the temperature and coking rate in each oven independently of the other ovens in the battery.

The duct system connected to the uptakes of each sole flue system is connected, above the ovens, to an elongated common combustion tunnel extending above and transversely of the ovens in the battery, and a stack connected to the combustion tunnel extends upwardly therefrom to provide a draft to all of the ovens in the battery as described in the above-identified copending application. In this respect, the term "battery" is used herein to designate the plurality of ovens connected through a common combustion tunnel to a single stack, although a plurality of such "batteries" may be constructed as a unit. For example, a single battery may consist of nine (9) ovens connected to each common tunnel and stack, with a plurality of such batteries constructed as a single in-line unit, in which case the term "battery" may also be used in the industry to refer to complete installation.

BRIEF DESCRIPTION OF THE DRAWINGS

The foregoing and other features and advantages of the invention will be apparent from the following detailed description, taken in conjunction with the drawings, in which:

FIG. 5 is an enlarged fragmentary sectional view taken along line 5—5 of FIG. 3;

FIG. 6 is a sectional view taken along line 6—6 of FIG. 3;

FIG. 7 is an enlarged sectional view taken along line 7—7 of FIG. 3;

FIG. 8 is a view showing a portion of the uptake draft control valve assembly; and FIG. 9 is a schematic illustration of a digital computer utilized in controlling operation of the coke battery in accordance with the invention; and FIG. 10 is an operational logic flow diagram for a control system for the coke battery shown in FIGS. 1-8.

DESCRIPTION OF THE PREFERRED EMBODIMENT

Figure 1:
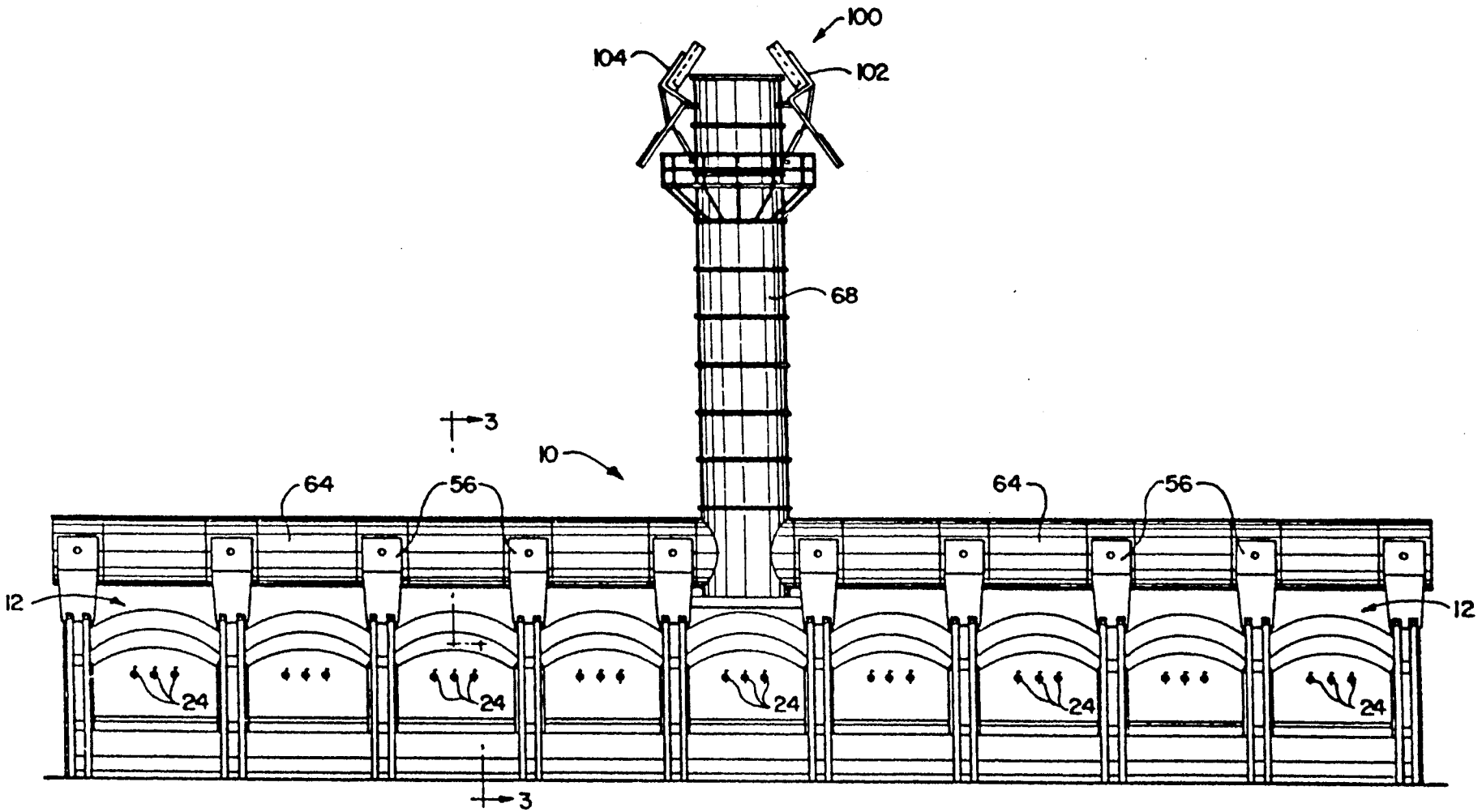
FIG. 1 is a front elevation view of a coal coking battery embodying the invention.
Figure 2:
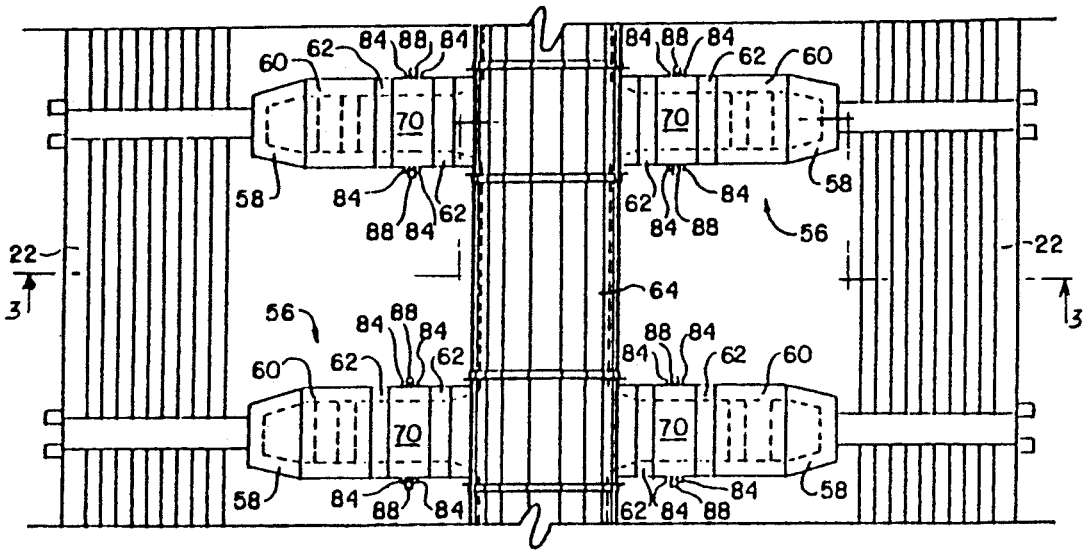
FIG. 2 is a top plan view of a portion of the structure shown in FIG. 1.

Referring now to the drawings in detail, a coal coking battery 10 with which the present invention is employed is illustrated as including a plurality of ovens 12 constructed in side-by-side relation with adjacent ovens having common sidewalls 14. The ovens 12 each have an elongated coking chamber 16 defined by the opposed vertically extending sidewalls 14, a generally arcuate roof 18 supported on the sidewalls, and a horizontal floor 20 which supports the charge of coal to be coked. The ovens are constructed with open ends which are closed during the coking cycle by substantially identical removable doors 22. Doors 22 preferably are of welded steel construction having a castable refractory lining, with a plurality of adjustable air inlets 24 formed in each door.

As best seen in FIGS. 5 and 6, the floor 20 is supported by the sidewalls 14 and by a plurality of parallel intermediate refractory brick walls 30 which cooperate to define a system of elongated sole flues 32 described below. A plurality of vertically extending downcomers, or channels, 42 are formed in each sidewall 14, with the downcomers each having an inlet 44 communicating with the top or crown portion of the associated coking chamber 16 and an outlet 46 leading into a sole flue tunnel 32 adjacent the sidewall 14. A plurality of chimneys, or uptakes 48 are also formed in each of the common sidewalls 14, with each uptake having an inlet 50 communicating with an adjacent sole flue tunnel 32. The uptakes extend upwardly through the walls 14 for communication with a chimney extension or duct system to be described more fully hereinbelow.

Figure 4:
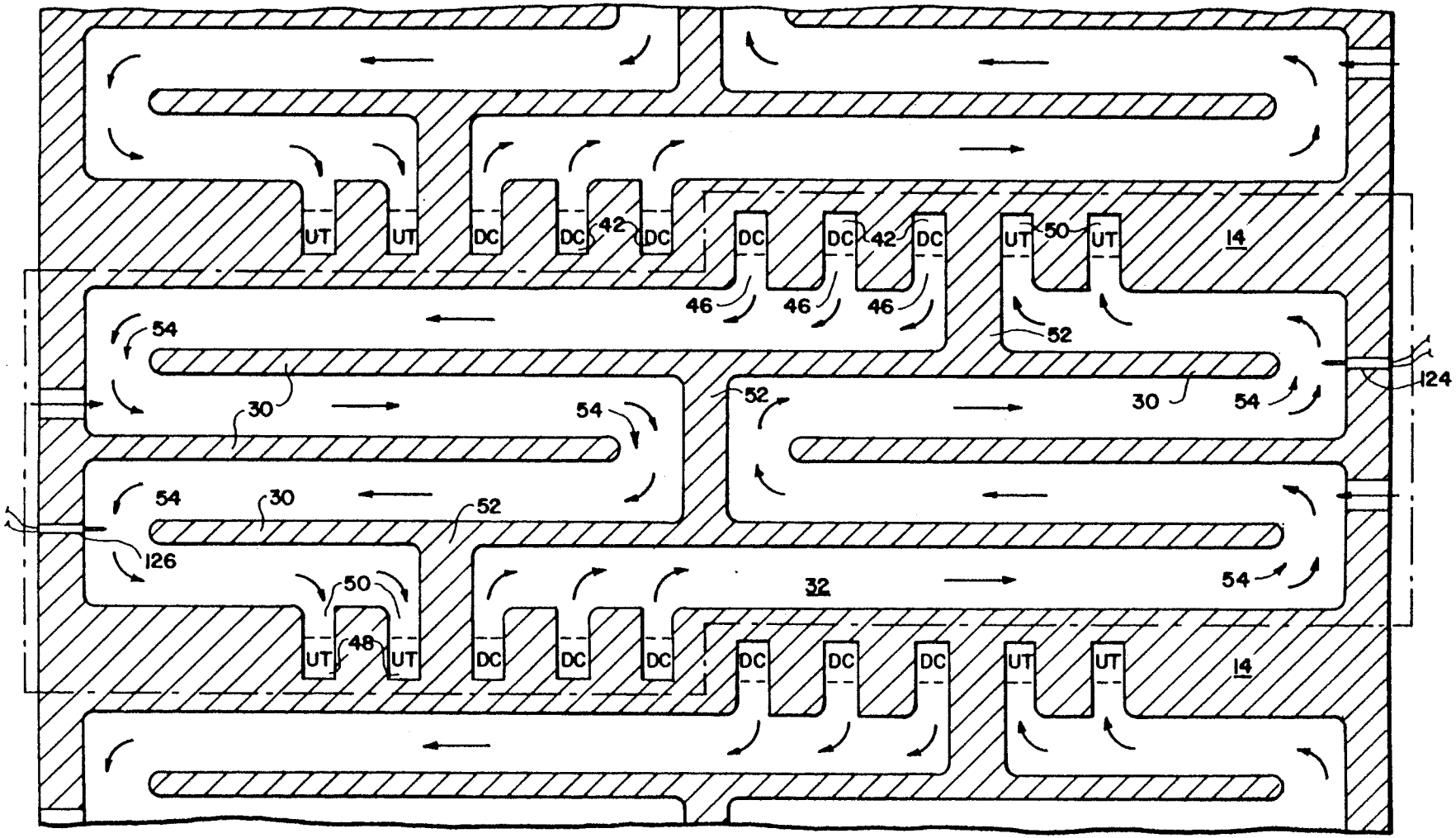
FIG. 4 is an enlarged sectional view taken along line 4—4 of FIG. 3.

Referring now to FIG. 4, it is seen that there are two separate systems of sole flues 32 beneath each oven 12. The two sole flue systems beneath an individual oven are enclosed within the broken line in FIG. 4, with the sole flue systems to either side of the area enclosed by the broken line being substantially identical and being associated with adjacent ovens in the battery. As shown, each sidewall 14 is formed with six downcomers and four uptakes, with the six downcomers being located in equally spaced relation, three on either side of the longitudinal centerline of the battery and preferably with the outboard uptake spaced from the longitudinal centerline a distance no more than about 25 percent, and preferably less than about 20 percent, of the total length of the individual oven. In one such battery, the total length of the oven is forty six feet, eight inches and the distance from the longitudinal centerline of the battery to the outer wall of the outer downcomer is eight feet three inches. The uptakes 48 are located in walls 14 outboard of the downcomers, with the outboard uptake preferably being spaced from the adjacent end of sidewall 14 a distance of at least about 20 percent and preferably about 25 percent of the total length of the oven.

A series of divider walls 52 extend perpendicular to the intermediate walls 30 and divide the respective sole flues 32 into two separate flue systems isolated from one another on opposite end portions of the oven. Adjacent parallel sole flues 32 of each system are interconnected at alternate ends thereof by crossover openings 54 in the walls 30 to provide continuous back-and-forth flow patterns traversing the width of the oven at each end thereof. The sole flue systems are generally referred to as the front and rear sole flues, with "front" and "rear" referring to the charging and pushing ends of the ovens, respectively.

The pair of uptakes 48 connected to each sole flue system are connected at the top of wall 14 to a common chimney extension or duct system designated generally by the reference numeral 56. Each duct 56 consists of an upwardly extending transition segment 58 in which the gases from the two uptakes are combined, an elbow 60, and a horizontally extending segment 62 connected to a common elongated waste heat or combustion tunnel 64 extending transversely of and above the roofs of the ovens in the battery. The duct systems 56 are constructed of a refractory lined metal conduit, and a draft control valve is connected in each horizontal section 62 for regulating the draft applied through the connected sole flue system to the associated oven chamber 16.

As best seen in FIG. 1, the common tunnel 64 extends across the full length of battery 10 (which in the embodiment illustrated, consists of nine ovens), and a single common stack 68 connected to the central portion of the combustion tunnel extends upwardly therefrom to apply a draft to the common combustion tunnel and thereby to the sole flue systems beneath all ovens in the battery.

Figure 3:
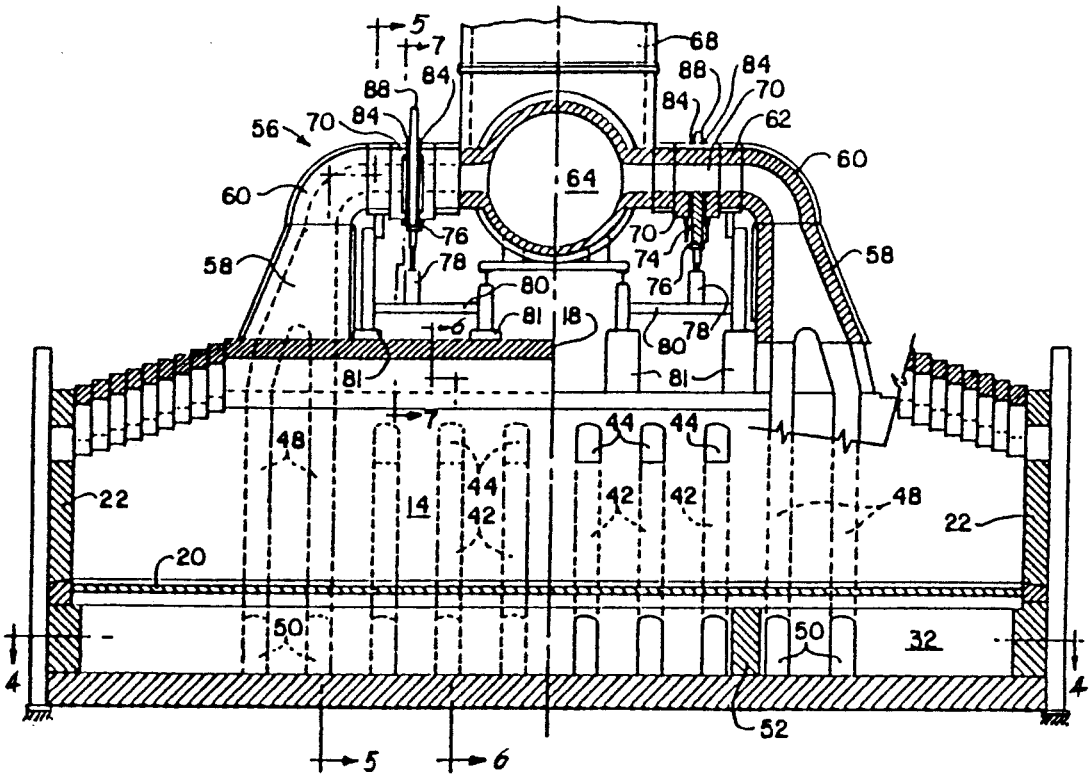
FIG. 3 is a longitudinal vertical sectional view taken along line 3—3 of FIG. 1.

Referring now to FIGS. 3, 7 and 8, the draft control valves 66 each comprise a refractory lined valve body 70 connected in conduit section 62, with the valve body having an opening in its bottom wall for receiving a refractory valve plate or damper 74 supported for vertical sliding movement into and out of the valve body between a fully raised position substantially completely closing the gas flow path through the duct system and a lowered position in which the gas flow path is substantially unobstructed. The refractory plate 74 is mounted on a horizontally extending metal base 76 which projects laterally outward from each side of the valve body 70, and a fluid cylinder 78 is provided to move the base and refractory plate in the vertical direction. Fluid Cylinder 78 is mounted in fixed position on a structural beam 80 supported by columns 81 on top of wall 14, and has its rod end pivotally connected through pin 82 to base 76.

A pair of vertically extending rectangular tubular members 84 are welded in spaced relation to one another on each outer vertical sidewall of the valve body 70 to define guide channels receiving a pair of guide posts 88 mounted on and projecting vertically upward from the opposed outwardly projecting end portions of base 76. Posts 88 are guided for vertical sliding movement in the guide channels to retain the refractory valve plate 74 in accurate alignment with the rectangular opening through the bottom of the refractory lined valve body 70. Guide rollers 90 mounted on posts 88 engage the outwardly directed surface of the rectangular tubes 84 to maintain the valve plates 74 and base 76 aligned transversely of the opening 72. The pin connection 82 is constructed with sufficient clearance to permit limited movement of the base 76 and of valve plate 74 relative to the fluid cylinder 78 to accommodate limited movement of the valve body as a result of thermal expansion and contraction of the duct system during operation.

As best seen in FIG. 8, one of the guide posts 88 carries a rack 94 which engages a pinion 96 supported on the valve body 70 for rotation by vertical movement of the rack with the valve plate. Pinion 96 is connected to a position indicator switch or potentiometer 98 which provides a feedback signal continuously indicating the position of the draft control valve.

Referring again to FIG. 1, it is seen that stack 68 is equipped with a draft control damper valve assembly 100 made up of two substantially identical subassemblies 102, 104 mounted on diametrically opposed sides of the stack adjacent its top. Each subassembly includes a refractory valve plate 106 rigidly mounted on a frame 108 supported for pivotal movement about a horizontal axis between the open and closed positions by fluid cylinders 110. In the closed position, the two valve plate members 106 cooperate to form a cover resting upon and sealing the open top of the stack 68. A heavy counterweight 112 is mounted on each frame 108 to counterbalance the weight of the valve plates 106. In the closed position, the damper valve assembly 100 effectively seals the top of the stack, cutting off all draft to the ovens to thereby preserve heat in the ovens in the event of a temporary shutdown of the battery. In the fully opened position, plates 106 offer essentially no resistance to gas flow, enabling these stacks to provide maximum draft to the ovens.

The stack draft control valve assembly 100 may be positioned to act as a damper, restricting the draft applied by the stack to the common tunnel and thereby to all the ovens in the battery. By controlling the draft to maintain the desired subatmospheric pressure in the common tunnel, the overall coking rate in the battery may be influenced while at the same time, adjustment of the chimney uptake draft control valves 66 permits adjustment of the draft to the individual ovens as required to produce a more uniform coking rate throughout the battery.

In accordance with the present invention, a high temperature thermocouple 120 is mounted in the arcuate roof 18 and projects into the crown portion of the coking chamber 16 of each oven 12 to continuously sense the actual temperature in the coking chamber above a charge of coal during the coking process. Similar thermocouples 122 and 124 are mounted in the front and rear sole flue systems, respectively, located beneath each oven to continuously monitor the temperature within the individual sole flue systems. The electric signal from thermocouples 120, 122 and 124 are fed to a process controller or computer 126, with the inputs being represented at 128, 130 and 132, respectively in FIG. 9. Also, an input signal from the draft control valve position indicator switch 98 is fed to the computer as indicated at 134, with the signals being interfaced through the computer input/output (I/O). The computer also includes a power supply device (PSD), a read only memory (ROM) which contains the instructions necessary to perform the algorithm embodying the subject inventive concepts, a random-access memory (RAM) used for storing computational results and calculation variables, and a central processing architecture embodying the CPU that controls the execution of instructions from the ROM, storing data in the RAM, reading and transmitting information through the I/O, and other functions of the computer to produce an output signal 136 to a control valve 138 which controls the application of fluid pressure to the fluid cylinder 78 to open or close the respective draft regulating valves 66.

In accordance with the present invention, the temperature in the coking chamber of each oven is automatically monitored and controlled throughout the coking operation from charging the oven with green coal and closing the oven to completion of the coking cycle. At the start of the cycle, the draft regulating valves 66 are all moved to the initial position to provide a high level of draft through the front and rear sole flue systems to the coking chamber. Since the oven has just been charged with relatively cold green coal, the temperature in the oven crown will initially be lowered than the desired or set temperature for coking which set temperature is programmed into the computer 126. The actual oven crown temperature will be monitored by the thermocouple 120 and the signal from this thermocouple compared to the set temperature, but no change will be made in the draft to thereby influence temperature in the oven crown until the measured temperature exceeds the set temperature by a predetermined amount. After comparing the crown temperature and set temperature, the temperature signals from thermocouples 122 and 124 are compared and, if the temperatures are the same, within acceptable limits, again no change in the draft will be made. If the temperature in the front and rear sole flue systems are sufficiently different, however, the draft regulating valve 66 controlling the draft through the sole flue system having the higher temperature will be closed by a predetermined increment or step to thereby reduce the draft, and consequently the temperature in that sole flue system will be reduced to equalize the temperature between the front and rear of the coking chamber, thereby providing more uniform coking along the full length of the oven.

It should be apparent that the substantial mass of a charge of coal and of the refractory structure of a coking oven of this type possesses substantial thermal inertia so that a change in draft does not result in an immediate temperature change either in the sole flue systems or in the oven crown. Accordingly, a time delay, or dead time is initiated following each draft adjustment so that no further change will be made until after the lapse of a predetermined time. In a coking oven of the type described above, wherein the coking cycle is normally forty eight hours, it has been found that a dead time of approximately one hour is sufficient for the temperature to stabilize following a draft control valve adjustment. This dead time is programmed to computer 126 so that no further adjustments in draft will be made despite an indication of an excessive crown temperature or an excessive differential temperature between the front and rear sole flue systems until after lapse of the preselected dead time as indicated in the general flow chart summarizing the operation of the system shown in FIG. 10. As indicated in this flow diagram, however, the system will continue to monitor the temperature in the oven crown and the front and rear sole flue systems and, after lapse of the predetermined dead time, any additional adjustments in the draft control valves required to adjust the temperature either in the crown of the oven, or in one of the sole flue systems to equalize the temperature between the front and rear sole flues, will be made in the same manner described above. This program will be repeated and adjustments made after successive dead times, as necessary, throughout the coking cycle.

While the control system has been described with respect to a single oven in the battery, all of the ovens in the battery are be monitored in the same manner and by the same process control computer to maintain the temperature in all ovens at substantially the same level throughout the coking cycle so that when the battery is pushed,. a uniform quality of coke is obtained from all ovens in the battery.

While a preferred embodiment of the invention has been disclosed and described, it should be apparent that the invention is not limited thereto and it is therefore intended to include all embodiments which would be apparent to one skilled in the art and which come within the spirit and scope of the invention.

What is claimed is:

1. A method of controlling the operation of an elongated nonrecovery coke oven in a battery including a plurality of such coke ovens constructed in side-by-side relation with each pair of adjacent ovens separated by a common sidewall, a separate system of sole flues located beneath the opposite ends of each of the ovens, a plurality of downcomers in each of the common sidewalls connecting the upper portion of each adjacent oven to one of the sole flue systems beneath that oven, a plurality of uptakes in each of the common sidewalls including at least one uptake connected to one of the sole flue systems beneath that oven, an elongated common exhaust tunnel extending above and transversely of the ovens in the battery, a stack connected to the exhaust tunnel and extending upwardly therefrom, and a duct system connecting the exhaust tunnel to said uptakes to provide a continuous gas flow path from each oven through said downcomers, sole flue systems, uptakes, duct system, exhaust tunnel and stack to the atmosphere, said duct system including separate duct means connecting said exhaust tunnel to said at least one uptake connected to each said sole flue system and draft regulating valve means in each said separate duct means, said draft regulating valve means being operable to control the flow of hot flue gases therethrough, the improvement comprising the steps of determining the desired temperature within said oven, sensing the temperature within said oven and producing a signal representative of the sensed temperature, comparing the sensed temperature in said oven to the desired temperature, adjusting the draft to said oven by adjusting the position of the draft regulating valve means connected through said duct means and said uptake means to the sole flue system beneath both ends of said oven in response to a predetermined difference between the sensed temperature and the desired temperature to thereby regulate the temperature in the oven, determining the temperature in the sole flue system beneath each end of said oven and comparing the determined sole flue temperatures, and adjusting the draft to one of said sole flue systems by adjusting the position of the draft regulating valve means in said duct means connected through said at least one uptake to said one sole flue system in response to a predetermined difference in the temperature in said sole flue systems beneath each end of the oven to thereby equalize the temperature in said sole flue systems beneath each end of said oven.

2. The method defined in claim 1 further comprising the step of initially positioning the draft regulating valves to provide maximum draft to said oven, and wherein the draft to said oven is adjusted by adjusting the draft regulating valves connected through said duct means and said uptakes to the sole flue system beneath both ends of said oven to reduce the draft to the oven only when the sensed temperature is higher than the desired temperature by a predetermined value.

3. The method defined in claim 1 wherein the step of adjusting the position of the draft regulating valve means to equalize the temperature in the sole flue systems beneath each end of the oven comprises adjusting the draft regulating valve to reduce the draft to the sole flue having the higher temperature.

4. The method defined in claim 1 wherein the draft regulating valve means are all initially positioned to provide maximum draft to the oven at the start of a coking cycle, and wherein the steps of adjusting the draft to the oven and to the sole flues comprises closing the draft regulating valves in predetermined increments.

5. The method defined in claim 4 further comprising the step of delaying further adjustment of said draft regulating valve means for a predetermined time following each such adjustment to thereby permit the temperature in the oven and sole flue system to stabilize following each such adjustment.

6. The method defined in claim 5 wherein said coke oven battery further includes a digital computer, and wherein the steps of determining the temperature in said oven and said sole flues comprises employing high temperature thermocouples located in the oven and in the sole flues and providing signals to the computer, and wherein said computer is employed to control adjustment of said draft regulating valve means in response to the signals from the high temperature thermocouples.

7. The method defined in claim 6 further comprising the step of initially positioning the draft regulating valves to provide maximum draft to said oven, and wherein the draft to said oven is adjusted by adjusting the draft regulating valves connected through said duct means and said uptakes to the sole flue system beneath both ends of said oven to reduce the draft to the oven only when the sensed temperature is higher than the desired temperature by a predetermined value.

8. The method defined in claim 7 wherein the step of adjusting the position of the draft regulating valve means to equalize the temperature in the sole flue systems beneath each end of the oven comprises adjusting the draft regulating valve to reduce the draft to the sole flue having the higher temperature.

9. The method defined in claim 8 further comprising the steps of determining the temperature in each oven and in the sole flue systems beneath each oven in the battery, and regulating the temperature in each said coke oven and in the sole flue systems beneath each said coke oven in response to the temperature determined in the respective ovens and in the sole flue systems beneath the respective ovens.

* * * * *